United States Patent [19]

Dillon et al.

[11] 4,014,192

[45] Mar. 29, 1977

[54] KEYED GATE LATCH

[75] Inventors: James C. Dillon, Santa Ana; Milton Robins, Marina del Rey, both of Calif.

[73] Assignee: PTI-DOLCO, Los Angeles, Calif.

[22] Filed: Dec. 12, 1975

[21] Appl. No.: 640,181

[52] U.S. Cl. ..... 70/77; 70/379 R; 292/210; 292/236

[51] Int. Cl.[2] ..... E05B 65/00

[58] Field of Search ..... 70/152, 77, 379 R; 292/226, 230–239, 210, DIG. 65, DIG. 71

[56] References Cited

UNITED STATES PATENTS

| | | | |
|---|---|---|---|
| 810,340 | 1/1906 | Meis | 292/210 X |
| 973,928 | 10/1910 | Edey | 292/236 |
| 1,496,551 | 6/1924 | McCulloch | 292/237 X |
| 2,274,259 | 2/1942 | Russo | 292/231 |
| 2,317,700 | 4/1943 | Thompson | 292/226 X |
| 2,824,441 | 2/1958 | Wartian | 292/226 X |
| 2,968,506 | 1/1961 | Lade | 292/DIG. 65 |
| 3,115,026 | 12/1963 | Moore | 292/238 X |
| 3,563,585 | 2/1971 | Welch | 292/234 X |

FOREIGN PATENTS OR APPLICATIONS

| | | | |
|---|---|---|---|
| 559,695 | 9/1932 | Germany | 70/152 |
| 3,491 | 5/1908 | United Kingdom | 292/226 |
| 11,905 | 3/1903 | United Kingdom | 292/234 |

*Primary Examiner*—Lawrence J. Staab
*Attorney, Agent, or Firm*—J. B. McGuire

[57] ABSTRACT

A gate latch including a body-mounted latch bolt which may be actuated to an elevated position from outside the gate by a lever extending through the gate to disengage the bolt from the latch strike. A lock device is provided which may be key-operated on the outside of the gate to locate a detent or cam element in a position to prevent movement of the lever, thus preventing the gate from being opened from the outside. Additionally, or alternatively, a cam or crank-like element may be actuated by the lock to prevent rotation of the latch bolt to unlock the gate. The element may be mounted so as to have a relatively slidable portion thereon which is actuatable, against a spring biasing force, to allow the bolt to be rotated, by one of the inside of the gate, to open the gate.

12 Claims, 4 Drawing Figures

FIG. 1
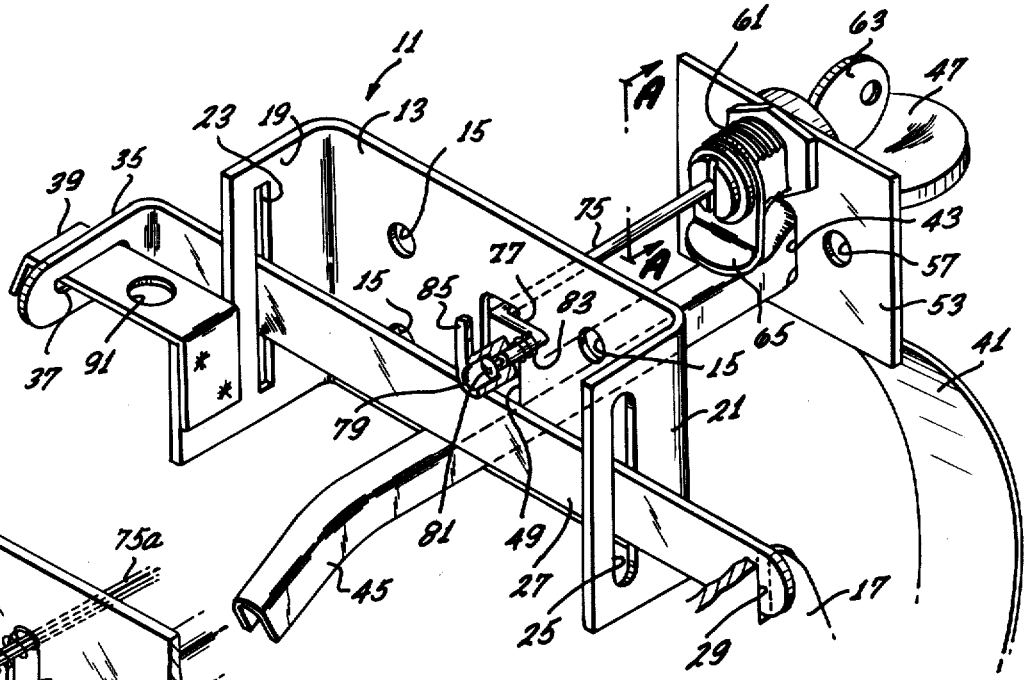
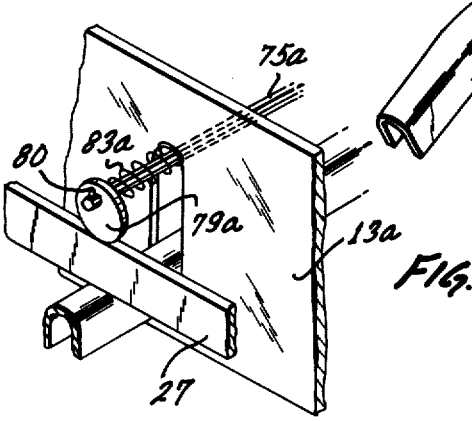
FIG. 4
FIG. 2
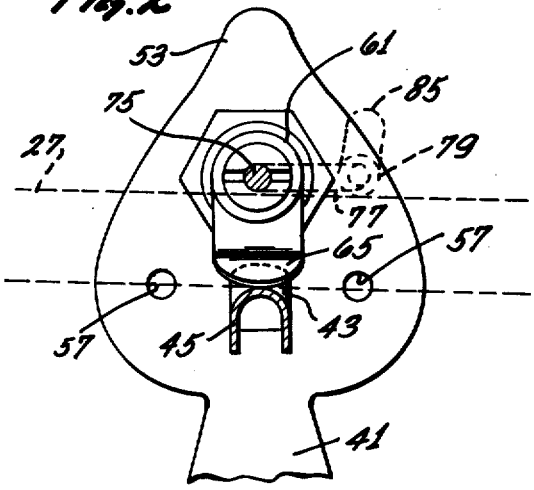
FIG. 3
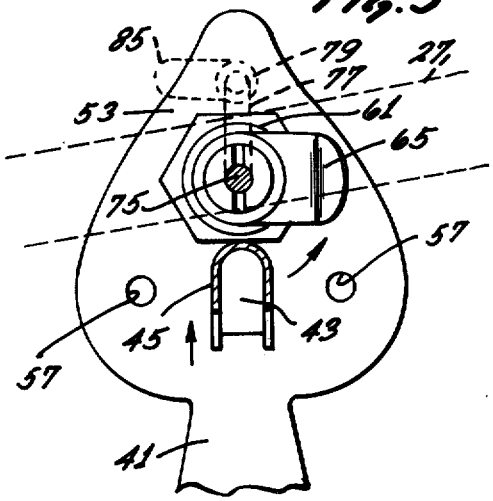

KEYED GATE LATCH

BACKGROUND OF THE INVENTION

The present invention relates to gate latches such as those commonly employed to limit entry to yards and other areas. Such a latch has been shown, for example, in U.S. Pat. No. 2,794,663.

In general, prior art latches have comprised a latch body throgh which a bolt pivotally extends for cooperation with a latch strike to maintain a gate in a closed position. In most cases, the latch body and bolt are mounted on the inside of the gate and the latch strike is mounted on a fixed post next to the gate, although the positions could be reversed if desired.

With devices of this nature, a handle is normally fixed on the outside of the gate. A thumb-activated lever, located near the upper part of the handle, extends through the gate and into the latch body. The lever is positioned so as to pivot the bolt away from its engagement with the latch strike to allow the gate to be opened.

In many instances, there is a need to lock the gate in order to prohibit entry into the enclosed area. For example, it may be necessary to lock the gate to prevent unauthorized entry into a swimming pool or similar area when the owner is away or simply desires privacy.

As shown by the above-cited U.S. Pat. No. 2,794,663, certain gate latch structures have beem employed to accomplish semi-permanent locking of the latch gate. These latches provided that the latch bolt be slidable through the body into an aperture in the latch strike which closely conforms to the size and shape of the bolt, thereby prohibiting the bolt from being moved about its pivot to unlatch the gate. When it is desired to more positively lock the gate, an aperture can be provided in the bolt through which the shackle of a padlock may be passed to prevent the lock from being pulled out of the latch strike aperture.

While this prior art structure provided a positive locking of the gate, it is disadvantageous because it prevents the owner of the enclosed area from entering the yard from the outside of the gate under any circumstances. It also prohibits him from leaving the yard without first unlocking the gate so that he can pass through it, leaving it unlocked since there is no way to relock it from the outside. Further, these prior art devices produce a potentially unsafe condition in which, in an emergency, a person inside the yard is positively prohibited from leaving the yard without first obtaining a key and opening the padlock. Under some circumstances, such as a fire, this could by disastrous.

SUMMARY OF THE INVENTION

Accordingly, in order to overcome these disadvantages, the present invention relates to such a gate latch which may be locked or unlocked from the outside. Further, in the preferred embodiments, the gate may be opened from the inside at any time without requiring access to a key; the person leaving the yard may close the gate behind him and it will relatch to its original condition in which it can be freely opened from the inside but not from the outside.

Although a variety of structures which are distinctive in their appearances may be employed to utilize the present invention, in the preferred embodiments which will be described here, a key-actuated lock may be employed. A detent or cam-like member may be fixedly mounted on the inner end of the lock so as to be pivoted to a position closely adjacent to the lever when it is desired to lock the gate from the outside. When the detent has been pivoted to that position, it is impossible for a person outside the gate to actuate the lever in order to lift the locking bolt and disengage it from the latch strike. On the other hand, a person inside the gate may simply lift the latch bolt from its engagement with the strike and thus open the gate. When he closes the gate, the bolt will reengage the strike and the gate will then be locked without further action being required.

If the owner or some other authorized person wishes to gain entry to the yard, he need only insert a key into the lock to turn the detent away from its position in proximity of the lever, allowing the lever to actuate the bolt to its unlatched position. Of course, at times the bolt may also be padlocked in the prior art manner, if desired to prohibit opening of the gate from either side. Thus, this constitutes a first locking structure.

In some instances, it will be possible for intruders to foil the device described above by sliding a card or tool between the edge of the gate and the adjacent structure to which the gate is latched and lifting the locking bolt out of its engagement with the strike. In order to prevent this, a shaft may extend from the axis of the inner end of the lock, through the gate, to a position in the plane of the locking bolt. An eccentric or crank-like end of the shaft may be provided with a telescopic sleeve which may extend into the rotational plane of the bolt so as to contact the bolt when the gate is to be locked, thus preventing the bolt from being pivoted away from the latch body. When the gate is unlocked, the eccentric or crank will be pivoted away from the bolt so that the latter may be moved when the lever is actuated. Alternatively, a straight shaft, having a hexagonal periphery, for example, may employ a cam or similar element for the same purpose. Therefore, for the remainder of this application, the various terms used shall each be construed to mean any such device which accomplishes the desired function.

In order to allow someone inside the gate to open it when it is locked, the sleeve on the eccentric end of the shaft or the cam on the straight shaft may be freely slidable along the end of the shaft, i.e., pushed out of the plane of the bolt. Similarly, it may be desirable to bias the sleeve or cam toward the rotational plane of the bolt, so that the gate will securely lock when it closes. Thus, this constitutes a second locking structure.

Of course, it will be realized by those skilled in the art that these two described types of locking structures may be used singly or together, as the need arises.

Many further advantages, objects, modes, and embodiments of this invention will readily be understood by those skilled in the art upon perusal of the following Detailed Description, taken together with the accompanying drawings, which describes what is presently considered to be a preferred embodiment of the best mode contemplated for utilizing the novel principles set forth in the claims. It will be realized, however, that the description and the accompanying illustrations are merely illustrative of the principles of the invention and of specific structures or embodiments which may be utilized in the employment of those principles. Therefore, the illustration and description are not to be considered to be restrictive of the invention defined in the claims.

BRIEF DESCRIPTION OF THE DRAWINGS

FIG. 1 comprises an isometric illustration of a gate latch formed in accordance with the present invention;

FIG. 2 comprises a view of that portion of the latch illustrated in FIG. 1 as seen along the line A-A, illustrating the relationships of the structural elements when the gate is locked;

FIG. 3 comprises a view similar to FIG. 2 showing the structural relationships when the gate is unlocked; and FIG. 4 is a partial view of another preferred embodiment formed in accordance with the present invention.

DETAILED DESCRIPTION

In the presently preferred embodiment of this invention, a gate latch, generally indicated at 11, may comprise a latch body 13 which may be fastened to a gate (not shown) by a plurality of screws (also not shown) which may be installed through predrilled bores such as 15. Preferably, the latch body is located on the inside of the gate so as to be in close proximity to a latch strike, partially illustrated at 17, which may be mounted on a fixed post adjacent the free end of the gate when the gate is closed. If desired, of course, the relative positions of these two elements could be reversed, i.e., the latch body mounted on the post and the latch mounted on the gate, and/or the elements located on the outside of the gate to prevent someone inside from passing out of an area through that particular gate.

The body 13 may include two end portions 19 and 21 which are oriented substantially perpendicular to the major portion of the body, as illustrated in FIG. 1. A vertical slot 23 may be located in the end portion 19 and a similar slot 25 may be located in the end 21 to allow a latch bolt or locking bar 27 to pass therethrough. As illustrated, the outer end of the latch bolt may cooperate with a partial slot 29 in the latch strike 17 to hold the gate in a closed position.

Although the latch bolt 27 may be mounted in any desired manner in order to cooperate with the latch strike 17, for the sake of illustration there has been shown an offset portion 35 thereon having a slot 37 which may extend over a keeper 39 which may be spot welded or otherwise attached to the end portion 19 of the latch body. By providing suitable clearance between the keeper 39 and the slot 37, sufficient play will be provided so that the latch or locking bolt 27 may pivot within a rotational plane about a substantially horizontal axis extending from one side of the slot 37 to the other.

On the outer side of the gate, a handle 41 may be provided in which a slot 43 may be formed so as to provide suitable passage for a lever 45. Preferably, the outer end of the lever 45 may be provided with a flattened suface or paddle 47 so that a finger, such as the thumb, of a person outside of the gate may be placed thereon.

The lever 45 may utilize the lower portion of the slot 43 in the handle 41 as a fulcrum when the paddle 47 is depressed. A vertical slot 49 may be provided in the latch body 13 so that the lever 45 may pass therethrough in substantial abutment with the lower edge of the latch bolt 27 as illustrated. Thus, when the paddle 47 is depressed by someone on the outside of the gate, the lever 45 will be elevated, lifting the latch bolt 27 out of the slot 29 and the gate may then be pulled or pushed open. The upper surface of the handle 41 may be provided with a flat plate 53 as illustrated in FIG. 1 in addition to or instead of an ornamental plate 55 as illustrated in FIG. 2 and 3 to ensure security of the lock against intruders. In either case, a plurality of apertures 57 may be provided therein so that the handle can be suitably fastened to the outer side of the gate.

A tumbler lock 61 may be suitably located in the handle and fastened thereto. Preferably, the lock is of such a type as may be actuated from the outside of the gate by a key 63.

At the inner end of the lock 61, a detent or cam-like member 65 may be suitably mounted for rotation with the operable portion of the lock when it is rotated by the key 63. As shown in FIG. 2, the detent 65 may be rotated into a position in which it is in relatively close abutment with the upper surface of the lever 45, thereby prohibiting the lever from moving upwardly about its fulcrum.

Alternatively, when the key is rotated in the lock, the detent 65 may be positioned as shown in FIG. 3 so as to be completely out of contact with the upper surface of the lever 45, allowing the latter to be moved about the fulcrum as illustrated in FIG. 3.

A careful examination of FIG. 1 will quickly reveal to those familiar with mechanisms of this type that the lever 27 may be manally lifted out of the slot 29 by a person on the inside of the gate and the gate may then be opened. When the gate is closed, the bolt 27 will ride over a camming surface of the latch strike in a well-known manner until it falls back into the slot 29. When the key 63 is removed and the detent 65 is in the position shown in FIGS. 1 and 2, no one on the outside of the gate will be able to open it since the paddle 47 cannot be depressed and the opposite end of the lever 45 cannot be elevated to lift the latch bolt 27. On the other hand, when the detent is rotated to the position shown in FIG. 3, pressure on the paddle 47 will cause the lever 45 to lift the latch bolt 27, allowing the gate to be opened from the outside.

In other words, this device allows the gate to be opened from inside at any time, while restricting the opening of the gate from the outside to those authorized persons having keys to the lock 61. When the gate is thus opened and then reclosed, it will still be locked against entry from the outside. Unauthorized entry can be prohibited without creating a dangerous situation in which a person could be trapped in the yard and unable to get out in an emergency.

As pointed out previously, intruders may, in some cases, open the gate from the outside by inserting a tool, credit card, or similar device through the gap between the gate and the element to which the latch strike 17 is attached, to lift the locking bar 27 out of the slot 29.

In order to prohibit that from happening, structure now to be described may be provided, either instead of or, preferably, in addition to the detent 65. As shown in FIG. 1, a shaft 75 may be suitably attached to the rotatable portion of the lock 61, for example, by being threading into a bore in the end of the lock. Thus, since the shaft 75 will effectively be fixed to the tumbler portion of the lock 61, it will rotate when the key 63 is turned in the lock. Those skilled in the art will realize that the shaft may either be coaxial or eccentric with the tumbler portion of the lock. For example, eccentricity may be desirable when necessary to provide suitable clearances between various elements of the structure.

In any event, a cam end 77 of the shaft, formed in the manner of a crank and eccentrically located on the opposite end of the shaft may be provided with a sleeve 79, shown partly in section in FIG. 1. The sleeve may be slidable in a direction parallel to the shaft axis, while removal of the sleeve 79 from the shaft crank end 77 may be prevented by means of a stop, such as a bolt 81 which may be threaded into the end of the shaft so that the bolt head seats in a counterbore in the sleeve 79. Preferably, a spring 83 may act between the inner end of the sleeve 79 and the offsetting portion of the shaft, as shown, to force the cam against the stop 81.

Although the sleeve 79 may slide along the shaft crank-like end 77, it may, if desired, be positively prevented from rotating relative to the shaft. Accordingly, the shaft may be provided with a hexagonal or rectangular periphery, a tongue-and-groove section, a keyway, etc., as desired, to prohibit such rotation.

When the lock 61 has been actuated to prohibit opening of the gate from the outside, the sleeve 79 will bear against the top surface of the locking bolt 27 in the manner illustrated in FIGS. 1 and 2, thereby prohibiting anyone on the outside of the gate from lifting the bolt 27 out of the slot 29 in the latch 17. However, when someone in the inside of the gate wishes to leave, he can push against the thumb lever 85 to move sleeve 79 toward the lock so that it no longer prohibits the rotational movement of the bolt 27. When he lets go of the thumb lever 85, the spring 83 will then force the sleeve back to the locking position to once again securely lock the gate. On the other hand, when the key is used to unlock the gate by rotating the tumbler portion of the lock 61, the eccentrically mounted sleeve 79 will be rotated away from contact with the locking bolt 27, as illustrated in FIG. 3, thereby allowing the bolt 27 to be freely actuated from either side of the gate by means of the structure described. If the sleeve is mounted on the shaft so that it cannot rotate relative thereto, there will be no danger of interference between the thumb lever 85 and latch bolt 27.

Of course, there may be times when it is desired to positively prohibit opening the gate from either side thereof. In such a case, the locking bolt 27 may be slid further into the keeper 17 so that it extends into a preformed bore in the gate post. When that is accomplished, the end 35 of the bolt will be to the right of an aperture 91 in the keeper 39, thereby allowing the shackle of a padlock (not shown) to be passed through the aperture 91, positively prohibiting movement of the bolt 27 to a position in which the gate could be opened.

Another embodiment of the invention is shown in FIG. 4 wherein shaft 75*a* is non-circular, at least adjacent one end thereof. For example, the shaft may be hexagonal along all or part of its length. A disc or cam 79*a* may be slidably mounted on the non-circular end of shaft 75*a* so as to be rotatable therewith. Perferably, cam 79*a* is urged into the pivotal plane of the locking bar against an abutment device 80 by a spring 83*a* acting between the cam and the body 13*a*. Thus when the lock 61 is activated, the cam will rotate into a locking position relative to the locking bar. When the lock is deactivated, the disc 79*a* will be rotated eccentrically about the axis of the shaft to allow the locking bar to be pivoted and the gate to be opened.

When the gate is locked and a person inside wishes to leave, he need only push cam 79*a* away from abutment device 80, which may be a pin, lift the bar 27, open the gate, and walk through.

Upon review of this description in light of the accompanying drawing, those skilled in the art will realize that the present invention, as defined by the following claims, may be employed in a wide variety of structures, which, in some cases may not even resemble the particular configuration described and illustrated.

We claim:

1. A gate latch for cooperation with a latch strike comprising
- a latch body having
  - means thereon about which a latch bolt may be pivotally moved to engage the bolt and the latch strike,
  - a latch bolt pivotally supported therein and extending beyond at least one end of said body for cooperation with a latch strike,
  - lever means extending into said body for selective actuation of said latch bolt to disengage the latter from the latch strike, said lever including
    - means for actuating said lever means from the side of the gate opposite to that upon which said body is mounted,
- means for selectively prohibiting actuation of said actuating means without limiting actuation of said latch bolt, and
- means for selectively prohibiting actuation of said latch bolt from the side of the gate opposite to that upon which said latch body is mounted including
  - lock means which may be locked and unlocked from the side of the gate opposite to that upon which said latch body is mounted, and
  - means actuated by said lock means into abutment with said latch bolt when said lock means is locked for prohibiting disengagement therefrom from the latch strike including
    - abutment means mounted for rotation, about an axis, in the plane of said latch bolt,
    - means for supporting said abutment means for such rotation and for movement out of the plane of said latch bolt, and
    - biasing means for urging said abutment means into the plane of said latch bolt.

2. A gate latch including
- a latch body which may be mounted on the inside of the gate,
- a pivotable locking bar located for cooperation with said latch body and a latch strike to latch the gate in a predetermined position,
- a lever means for extension through said latch body to pivot said locking bar out of engagement with the latch strike including
  - means for actuating said lever means from the side of the gate opposite to that upon which said latch body is mounted,
- means for prohibiting operation of said lever means by said actuating means including
  - stop means which may be selectively located in close abutment with said lever means from the side of the gate opposite to that upon which said latch body is mounted, and
  - key actuated lock means having a rotatable structure therein upon which said stop means may be fixed for rotation into and out of close abutment with said lever, and
- means for prohibiting pivoting of said locking bar by a person outside the gate comprising abutment means mounted closely adjacent said locking bar and extending into the plane of rotation thereof, means for urging said abutment means into the plane of rotation of locking bar, and means for supporting said abutment means for movement out of the plane of rotation of said locking bar.

3. A gate latch mechanism comprising latch body means to be mounted on the inside of a swingable gate, latch strike means to be mounted on a fence post in close proximity to said latch body means when the gate is closed, latch bolt means mounted on said latch body means and extendable therefrom for cooperation with said latch strike means to hold the gate in the closed position, handle means to be mounted on the outside of the gate, finger-actuated lever means extendable through the gate from said handle means and into said latch body means for actuation of said latch bolt means to remove it from cooperation with said latch strike means, means for preventing actuation of said lever means to prohibit the opening of the gate from the outside thereof, while not interfering with manual actuation of said latch bolt means so that the gate may be opened from the inside thereof and relatched upon subsequent closure including lock means mounted on said handle means and detent means fixedly mounted onto said lock means for selective rotation between a first position substantially removed from said lever means and a second position adjacent said lever means to prevent movement thereof sufficient to actuate said latch bolt means, and means mounted for rotation with said lock means for selective prohibition of actuation of said latch bolt when said detent means is prohibiting actuation of said lever means.

4. The mechanism of claim 3 wherein said last-recited means comprises shaft means operatively connected to said lock means for rotation therewith and having crank-end means thereon at the end opposite said lock means, means slidably mounted on said crank-end means for limited movement relative thereto, and means for biasing said slidably mounted means into the plane of rotation of said latch bolt.

5. A gate latch including a latch body which may be mounted on the inside of a gate, a pivotable locking bar located for cooperation with said latch body and a latch strike to latch the gate in a predetermined position, lever means for extension through said latch body to pivot said locking bar out of engagement with the latch strike including means for actuating said lever means from the side of the gate opposite to that upon which said latch body is mounted, and means to selectively prohibit pivoting of said locking bar by a person on the outside of the gate including means which may be selectively located in close abutment with said locking bar from the side of the gate opposite to that upon which said latch body is mounted, and key actuated lock means having a moveable abutment means operatively connected for rotation therewith into close abutment with said latch bolt comprising sleeve means slidably mounted on a crank-like end of a shaft fixed to said lock means, means for urging said sleeve means into the plant of rotation of said latch bolt, and means for limiting the amount of travel of said sleeve means under the force exerted by said urging means.

6. The latch of claim 5 including means operatively connected to said lock means for selectively prohibiting actuation of said lever means.

7. The latch of claim 5 including means for selectively prohibiting actuation of said lever means.

8. A gate latch mechanism comprising a latch body, locking bar means pivotally mounted on and extending from said latch body, lever means extending into said latch body in operative relationship with said locking bar to actuate the latter about its pivot mounting in said latch body, and means for selectively preventing actuation of said locking bar means including lock means mountable in fixed relationship with said latch body for rotation thereof by a key, shaft means operatively connected to said lock means for rotation together therewith, abutment means mounted on said shaft means for rotation therewith and axial movement relative thereto, and means for biasing said abutment means into the plane of said locking bar to prohibit pivotal movement thereof when said lock means is in a first position and to allow pivotal movement thereof when said lock means is in a second position.

9. The mechanism of claim 8 wherein said abutment means includes means for actuation of said abutment means axially relative to said shaft means to move said abutment means out of the plane of said locking bar when said lock is in the first position.

10. The mechanism of claim 9 including means operatively connected to said lock means for selectively prohibiting actuation of said lever means without otherwise interfering with said locking bar means.

11. The mechanism of claim 9 including means operatively connected to said abutment means for preventing actuation of said lever means without otherwise interfering with said locking bar means.

12. The mechanism of claim 8 wherein said abutment means includes disc means mounted on said shaft means for rotation with said shaft means and for selective movement along the axis thereof.

* * * * *